US012680244B2

(12) United States Patent
Bach et al.

(10) Patent No.: US 12,680,244 B2
(45) Date of Patent: Jul. 14, 2026

(54) SELF-PROPELLED EARTH WORKING MACHINE HAVING AN ELECTRICALLY DRIVEN WORKING APPARATUS AND A BALANCED WEIGHT DISTRIBUTION

(71) Applicant: Wirtgen GmbH, Windhagen (DE)

(72) Inventors: Markus Bach, Bonn (DE); Philipp Prassel, Neustadt/Wied (DE)

(73) Assignee: Wirtgen GmbH, Windhagen (DE)

( * ) Notice: Subject to any disclaimer, the term of this patent is extended or adjusted under 35 U.S.C. 154(b) by 52 days.

(21) Appl. No.: 18/703,952

(22) PCT Filed: Nov. 11, 2022

(86) PCT No.: PCT/EP2022/081632
§ 371 (c)(1),
(2) Date: Apr. 23, 2024

(87) PCT Pub. No.: WO2023/084029
PCT Pub. Date: May 19, 2023

(65) Prior Publication Data

US 2024/0417936 A1 Dec. 19, 2024

(30) Foreign Application Priority Data

Nov. 12, 2021 (DE) ..... 10 2021 129 619.6

(51) Int. Cl.
*E01C 23/088* (2006.01)

(52) U.S. Cl.
CPC ..... *E01C 23/088* (2013.01)

(58) Field of Classification Search
None
See application file for complete search history.

(56) References Cited

U.S. PATENT DOCUMENTS 3,946,506 A * 3/1976 Snow, Jr. ..... E02F 3/783 198/301
4,325,580 A * 4/1982 Swisher, Jr. ..... E01C 23/088 404/90

(Continued)

FOREIGN PATENT DOCUMENTS

CA 3054648 A1 * 3/2020 ..... E01C 23/088
CN 113580946 A 11/2021

(Continued)

OTHER PUBLICATIONS

English Translation JP 2008069517 (Year: 2008).*

(Continued)

*Primary Examiner* — Jong-Suk (James) Lee
(74) *Attorney, Agent, or Firm* — Lucian Wayne Beavers; Patterson Intellectual Property Law, PC

(57) ABSTRACT

An earth working machine includes a machine frame, a plurality of rollable drive units, a rotatable working apparatus rotatable about an axis of rotation, an electric work drive, an electrical energy store, and a receiving configuration for receiving a conveyor. In a reference state in which the earth working machine stands on level ground the electrical energy store and the receiving configuration are located on opposite sides of a reference plane containing the axis of rotation and extending orthogonal to the level ground.

12 Claims, 1 Drawing Sheet

(56) References Cited

U.S. PATENT DOCUMENTS

| | | | | |
|---|---|---|---|---|
| 4,647,248 | A * | 3/1987 | Wirtgen | E01C 23/088 404/90 |
| 4,723,867 | A * | 2/1988 | Wirtgen | E01C 23/08 404/90 |
| 4,808,026 | A * | 2/1989 | Clarke, Jr. | E01C 19/187 404/90 |
| 5,441,361 | A * | 8/1995 | Campbell | E01C 23/065 404/90 |
| 6,296,318 | B1 * | 10/2001 | Simons | E01C 23/088 404/90 |
| 6,457,779 | B1 * | 10/2002 | Busley | E01C 23/088 299/39.5 |
| 8,256,847 | B2 * | 9/2012 | Hall | E01C 23/088 299/39.4 |
| 8,622,480 | B2 | 1/2014 | Weckerly et al. | |
| 8,660,724 | B2 | 2/2014 | Tarasinski et al. | |
| 8,915,550 | B2 * | 12/2014 | Jeevanantham | E01C 23/088 299/39.2 |
| 10,000,897 | B2 | 6/2018 | Reuter et al. | |
| 10,724,188 | B2 | 7/2020 | Berning et al. | |
| 11,236,472 | B2 * | 2/2022 | Mannebach | E01C 23/088 |
| 11,660,604 | B2 * | 5/2023 | Argenziano | B02C 25/00 241/101.2 |
| 2011/0248110 | A1 * | 10/2011 | Graner | E21C 31/02 241/101.2 |
| 2013/0082511 | A1 * | 4/2013 | Weckerly | E01C 23/088 198/318 |
| 2015/0091363 | A1 | 4/2015 | Reuter et al. | |
| 2016/0040371 | A1 * | 2/2016 | Roetsch | E01C 23/088 299/39.4 |
| 2016/0281305 | A1 * | 9/2016 | Hsieh | E01C 23/088 |
| 2017/0362784 | A1 * | 12/2017 | Hoffmann | E01C 23/127 |
| 2020/0063385 | A1 * | 2/2020 | Verhaelen | E01C 23/088 |
| 2022/0064879 | A1 * | 3/2022 | Stahl | G01C 21/12 |
| 2022/0185114 | A1 | 6/2022 | Bebeti et al. | |
| 2022/0334551 | A1 * | 10/2022 | Sommer | G05B 19/406 |
| 2022/0389666 | A1 | 12/2022 | Farr et al. | |

FOREIGN PATENT DOCUMENTS

| | | | | |
|---|---|---|---|---|
| CN | 216427939 | U | 5/2022 | |
| DE | 102004012767 | A1 | 10/2005 | |
| DE | 102010014649 | A1 | 1/2012 | |
| DE | 102012006189 | A1 | 10/2013 | |
| DE | 112012004074 | T5 | 7/2014 | |
| DE | 102016208242 | A1 | 11/2017 | |
| DE | 102017220518 | A1 | 11/2018 | |
| DE | 112019000005 | T5 | 8/2020 | |
| DE | 102019203731 | A1 | 10/2020 | |
| DE | 102020002161 | A1 * | 10/2021 | E01C 23/088 |
| EP | 2426258 | A2 * | 3/2012 | E01C 23/088 |
| JP | H10331204 | A * | 12/1998 | |
| JP | 2008069517 | A * | 3/2008 | |
| JP | 2009097270 | A | 5/2009 | |
| JP | 2009215855 | A | 9/2009 | |
| WO | 2020059164 | A1 | 3/2020 | |

OTHER PUBLICATIONS

English Translation JP H10331204 (Year: 1998).*

International Preliminary Report of Patentability for corresponding PCT/EP2022/081632, dated May 2, 2024, 8 pages (not prior art).

Reference D2—Wirtgen: "Abgasfreie Kleinfräse mit elektrischem Antrieb—Kaltfräse W 350 E," 2012, pp. 1-8, XP093024370, Germany [retrieved on Feb. 16, 2023].

European Search Report for corresponding patent application 22206937.9 dated Apr. 5, 2023, 13 pages (not prior art).

Brochure for Kaltfräse W 350 E—URL:https://docplayer.org/47973589-Abgasfreie-kleinfraese-mit-elektrischem-antrieb-kaltfraese-w-350-e.html; dated May 2012 (May 31, 2012).

Third Party Objection dated Nov. 14, 2023, filed in corresponding German Application DE 102021129619.6 (not prior art).

English machine translation of Party Objection dated Nov. 14, 2023 filed in corresponding German Application DE 102021129619.6 (not prior art).

Third Party Objection dated Nov. 29, 2023, filed in corresponding German Application DE 102021129619.6 (not prior art).

English machine translation of Party Objection dated Nov. 29, 2023 filed in corresponding German Application DE 102021129619.6 (not prior art).

"Hybride und energieeffiziente Antriebe fur mobile Arbeitsmaschinen", Feb. 15, 2017, (214 pages).

Google translation of "Hybride und energieeffiziente Antriebe fur mobile Arbeitsmaschinen", Feb. 15, 2017.

* cited by examiner

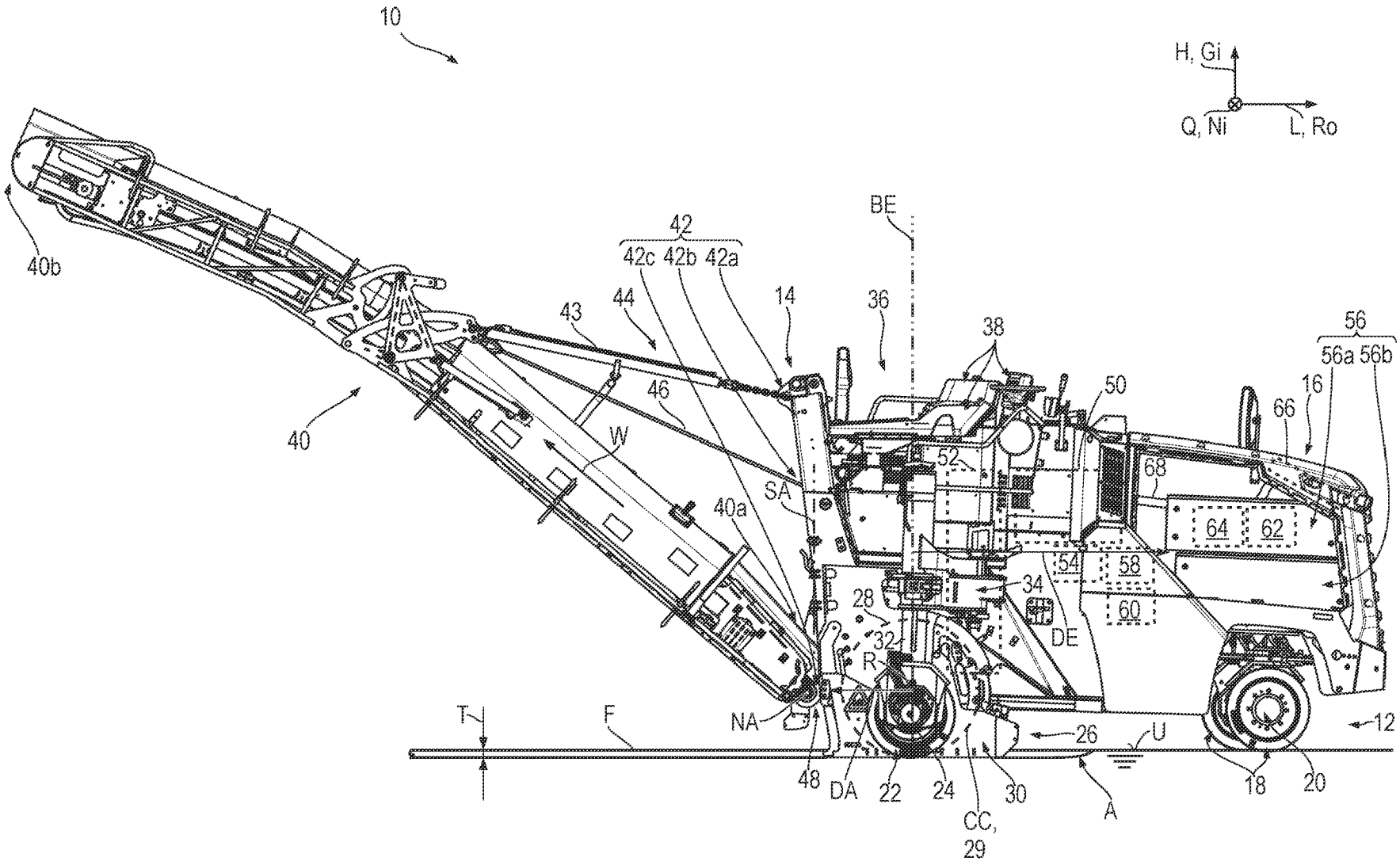
10
12
14
16
18
20
22
24
26
28
29
30
32
34
36
38
40
40a
40b
42
42a
42b
42c
43
44
46
48
50
52
54
56
56a
56b
58
60
62
64
66
68
A
BE
CC,
DA
DE
F
NA
R
SA
T
U
W
H, Gi
Q, Ni
L, Ro

SELF-PROPELLED EARTH WORKING MACHINE HAVING AN ELECTRICALLY DRIVEN WORKING APPARATUS AND A BALANCED WEIGHT DISTRIBUTION

The present invention relates to a self-propelled earth working machine, comprising a machine frame and a traveling gear supporting the machine frame, the traveling gear comprising a plurality of drive units rollable on a contact ground surface of the earth working machine, the machine frame supporting a working apparatus for ground removal work, the working apparatus being accommodated on the machine frame so as to be rotatable about an axis of rotation, the earth working machine comprising an electric work drive in order to drive the working apparatus to perform a rotating working movement effecting the ground removal work during a ground removal operation, the earth working machine comprising an electrical energy source, which outputs electrical energy to the working apparatus during the ground removal operation, and the earth working machine having a receiving configuration, which is suitable and designed for receiving a conveyor apparatus designed to transport removed ground material.

A self-propelled earth working machine of this kind, which may take the form of a surface miner or an asphalt milling machine, is known from DE 10 2010 014 649 A1. The known earth working machine comprises a milling drum driven by an electric motor, which obtains the electrical energy it requires from a generator as an electrical energy source, which itself in turn is driven by a combustion engine.

As the central power source of the known earth working machine, the combustion engine emits exhaust-gas emissions into the air, which in terms of quantity are directly proportional to the total power required by the earth working machine. It is an objective of the present invention to develop the known earth working machine further for a ground removal operation that is lower in emissions and yet continues to be stable.

The present invention achieves this objective in a self-propelled earth working machine mentioned at the outset in that the electrical energy source is an electrical energy store, wherein in a reference state, in which the earth working machine stands ready for operation on level ground, the electrical energy store on the one hand and the receiving configuration on the other hand are situated on different sides of a reference plane that contains the axis of rotation of the working apparatus and that is orthogonal to the contact surface of the ground. The reference plane thus contains the axis of rotation and runs parallel to the yaw axis of the earth working machine.

By using an electrical energy store as the electrical energy source, the earth working machine may be able to work entirely without a combustion engine or a smaller combustion engine than previously suffices as a kind of auxiliary unit for driving only a generator and/or only a hydraulic pump for generating electrical current or hydraulic pressure, so that the combustion engine then emits considerably less emissions per unit of time, since it does not have to provide the entire power of the earth working machine.

In the operationally ready state, the conveyor apparatuses provided on earth working machines project far away from the machine frame. Due to the customary use of revolving conveyor belts, of rollers supporting and guiding the conveyor belts, and frames supporting the rollers and the conveyor belts, a conveyor apparatus has a comparatively high weight and due to its projecting attachment produces a comparatively high tipping moment about the respectively nearest drive units or about a traveling gear axle formed by the respectively nearest drive units or about the working apparatus engaging with the ground in ground-removing fashion.

The conveyor apparatus is normally situated in detachable fashion on the machine frame, so that the conveyor apparatus may be detached from the machine frame for example for transporting the machine or for maintenance purposes and that thus for example the transport volume of the components of the earth working machine may be reduced to a degree that ensures the use of means of transport that do not require special permits. Alternatively or additionally, the removal of the conveyor apparatus allows for improved accessibility of components of the earth working machine and/or of the transport device.

The receiving configuration of the earth working machine for receiving the conveyor apparatus defines with sufficient precision the position and limits of a possible orientation of the conveyor apparatus in the operationally ready state. The mentioned arrangement of the electrical energy store and the receiving configuration on different sides of the reference plane and thus of the axis of rotation of the material-removing working apparatus is able to ensure that during normal ground removal operation the normally likewise very heavy electrical energy store on the one hand and a conveyor apparatus sufficiently determined in its arrangement on the machine frame by the receiving configuration on the other hand do not produce a tipping moment acting on the machine frame supporting both components that would be great enough to tip the earth working machine about a drive unit or about the working apparatus engaging in the ground in material-removing fashion. On the contrary: The weight of the two components on both sides of the reference plane and thus of the axis of rotation of the working apparatus may be used advantageously in order to load the ground-removing working apparatus during the ground removal work in the direction toward the ground and thus to reinforce or ensure the engagement of the working apparatus in the ground to be worked.

The mentioned reference plane is easy to ascertain and is technically particularly useful. The axis of rotation of the working apparatus is immediately recognizable in any earth working machine. The same is true of the yaw axis of the earth working machine. The reference plane therefore normally intersects the rotational cutting body defined by all cutting tools on the rotating working apparatus at its lowermost dead center in ground removal operation in the transition area between a ground-removing cutting engagement of the working apparatus and a worked ground section extending away from the working apparatus counter to forward travel direction of the forward travel produced by the traveling gear when viewed in a machine frame-fixed coordinate system.

Since the receiving configuration, as already explained above, prescribes the rough area with sufficient precision, in which the conveyor apparatus is located on the machine frame in the operationally ready state, the advantages of the present invention are already realized by the arrangement of the electrical energy store relative to the reference plane and to the receiving configuration in the aforementioned manner. The practical value of the present invention, however, is manifested in a special way during ground removal work or at least while the earth working machine is prepared for such an operation. Hence, the aforementioned relative arrangement yields its advantageous effect in particular when a conveyor apparatus is accommodated on the receiving configuration, which is designed and positioned to convey ground material removed during ground removal operation away from the working apparatus. Ground material lying on the conveyor apparatus during ground removal operation even increases the tipping moment exerted by the conveyor apparatus on the machine frame by increasing the weight of the conveyor apparatus.

In order to be able to compensate sufficiently for a tipping moment effected by the conveyor apparatus, the electrical energy store is preferably just as far removed from the reference plane as the receiving configuration, particularly preferably further removed from the reference plane than the receiving configuration. If the receiving configuration is formed by multiple partial receiving configurations, the partial receiving configuration closest to the reference plane determines the distance of the receiving configuration from the reference plane. If the electrical energy store is composed of multiple separate energy store units, then the distance of the electrical energy store from the reference plane is formed by the arithmetic mean of the individual distances of the energy store units forming the energy store-weighted with the respective weight of the respective energy store unit—from the reference plane.

Since the conveyor apparatus and its receiving configuration normally extend close to the working apparatus without colliding with the latter, the receiving configuration is at a distance from the reference plane that amounts to at least half of the maximum diameter of the rotational cutting body formed by the rotating working apparatus. The distance of the electrical energy store from the reference plane then preferably amounts to at least the maximum radius of the mentioned rotational cutting body, particularly preferably to at least one and a half times, particularly preferably at least two times this radius.

Likewise preferably, the distance of the electrical energy store from the receiving configuration along the roll axis corresponds at least to the dimension of the maximum diameter of the mentioned rotational cutting body, particularly preferably to one and a half times, more preferably to at least two times, even more preferably to more than two times this diameter.

In case the working apparatus is developed as a milling drum, the maximum diameter of the mentioned rotational cutting body is the diameter of the greatest cutting circle realized on the milling drum. If the rotational cutting body has only one diameter, then this is the maximum diameter.

The earth working machine is preferably a so-called "rear loader" machine, in which the conveyor apparatus is situated at the rear end of the vehicle and projects away from the machine frame in a direction opposite to the forward travel direction. These rear loader machines usually have rather smaller nominal working dimensions, such as milling or cutting width, for which the present invention in its further developments offers numerous additional advantageous technical solutions.

In principle, the conveyor apparatus may be any conveyor apparatus. In the present case, the conveyor apparatus is preferably a conveyor apparatus projecting from the machine frame and conveying material away from the working apparatus, as it is already known in the related art in the aforementioned conveyor apparatus having at least one revolving conveyor belt. In this case, the carrying side, on which the removed ground material is deposited in operation, moves in the conveying direction from a receiving area situated closer to the working apparatus to a longitudinal discharge end, at which the removed ground material transported on the carrying side is discharged by the conveyor apparatus in the conveying direction. The non-loaded return side of the revolving conveyor belt moves in the opposite direction from the longitudinal discharge end toward the receiving area.

A further component of an electrically driven working apparatus of a ground-removing earth working machine is the electric work drive of the working apparatus. Within the scope of the present invention, a possible, advantageously lossless arrangement of the electric work drive with short transmission paths of kinetic energy from the electric work drive to the working apparatus is an arrangement of the work drive radially within the rotating working apparatus. In this case, however, the electric work drive is highly stressed by the mechanical cutting force reaction of the ground-removing cutting engagement on the working apparatus and by the generally high level of dirt in the environment near the cutting engagement. According to an advantageous development of the present invention, these mechanical and dirt-induced stresses on the electric work drive may be reduced in that the electric work drive is situated outside of the working apparatus and is connected to the latter by a transmission situated at least partially outside of the working apparatus, and preferably also outside of an apparatus housing, such as a milling drum housing, accommodating the working apparatus and shielding it with respect to the external surroundings. For then it is possible to decouple the work drive in operation to a certain degree from the mechanical reactions on the working apparatus for example by the interposition of damping elements between the work drive and the machine frame or even merely by utilizing the internal damping of the machine frame over the distance from the working location. The same is true of the stress through dust and other dirt at the cutting engagement location.

An electric work drive arranged radially outside of the working apparatus offers a further advantage if, according to a preferred development, the working apparatus is advantageously provided in exchangeable fashion on the machine frame, for example in order to allow for varying working widths. Varying working widths of a rotating working apparatus usually manifest in varying axial dimensions of the working apparatus. In the case of axially shorter working apparatuses, it may be the case that they do not completely surround the electric work drive in spite of its being situated radially within the rotational cutting body and that they thus are not able to shield the electric work drive sufficiently against undesired influences from the location of the material-removing cutting engagement because the electric work drive protrudes axially beyond at least one longitudinal end of the working apparatus.

For the further compensation of a tipping moment effected by the conveyor apparatus in the operationally ready state, in particular if heavy components such as a combustion engine and an electric generator are eliminated, the electric work drive may be situated preferably along a roll axis of the earth working machine extending parallel to the longitudinal machine direction between the reference plane and the electrical energy store.

For achieving the best possible maneuverability, the earth working machine is designed like a vehicle, i.e., the rollable drive units form traveling gear axles. Two rollable drive units may be situated along the roll axis at identical roll axis coordinates, but at a distance from each other along a pitch axis running in the transverse machine direction. Since in the present case this concerns a virtual, not a physical, traveling gear axle, each of the drive units forming a traveling gear axle may be rotatable about a steering axle and thus be steerable.

An individual rollable drive unit may also form a traveling gear axle. The roll axis of the drive unit is then a traveling gear axle. This is presently of particular interest since the aforementioned working apparatuses having a lesser width are frequently situated on traveling gears having only three drive units. In this case, two drive units preferably form one traveling gear axle and the third drive units a further traveling gear axle.

Two drive units also form a common traveling gear axle when the contact areas of the two drive units are offset from one another along the roll axis by less than half of the maximum longitudinal dimension of the drive units measured along the roll axis in straight-ahead travel. Hence, in the case of wheel drive units, the offset along the roll axis is not greater than the radius of the wheel drive units. The use of identical drive units is preferred for forming a traveling gear axle. If, quite unusually, they are not of the same size, half of the longitudinal dimension of the larger or of the longer drive unit is to be used for assessing the offset and the formation of a traveling gear axle. With a small offset of the two drive units of one traveling gear axle it is possible to achieve a greater maximum steering angle of the preferably steerable drive units of one traveling gear axle compared to an arrangement at the same roll axis position. This is advantageous especially if the drive units of the traveling gear axle have little space between them in the pitch axis direction, so that they could strike against each other when performing a steering motion. For this reason, the drive units are preferably arranged along the roll axis with the aforementioned small offset if their distance from each other along the pitch axis amounts to two thirds or less of their longitudinal dimension. In the case of drive units of unequal size, the longitudinal dimension of the larger one of the drive units of the traveling gear axle is to be used for assessing the distance in the pitch axis direction. Such a small distance between two drive units of one traveling gear axle occurs preferably on a front axle of the traveling gear.

The electrical energy store may in general comprise two or more partial stores in separately developed partial store housings, which cooperate as one electrical energy store by appropriate wiring and storage control.

For a particularly stable operation, at least a portion of the electrical energy store is preferably situated above a traveling gear axle. In that case, at least the portion of the electrical energy store situated above the traveling gear axle is able to exert a load directly on the traveling gear axle and ensure a secure footing of the earth working machine with the loaded traveling gear axle on the ground on which the earth working machine is traveling. Preferably several, particularly preferably all portions of the electrical energy store are situated above the traveling gear axle.

Expediently, the rollable drive units preferably form a traveling gear front axle and a traveling gear rear axle. Especially in earth working machines having a small working width, for example of 120 cm or less, the traveling gear rear axle often bears a greater load than the traveling gear front axle due to the working apparatus and the conveyor apparatus. The at least one portion of the electrical energy store, particularly preferably the entire electrical energy store, is situated above the traveling gear front axle.

The formation of a traveling gear axle, in particular of a traveling gear rear axle, by two drive units situated next to each other along the pitch axis of the earth working machine does not exclude the possibility that one of these drive units is displaceable along the roll axis, for example swivable in front of the working apparatus in a manner known per se, in order to allow the working apparatus to approach an obstacle along the pitch axis, such as for example a curb, a wall and the like. This makes it possible to perform ground work directly along the obstacle, which is otherwise prevented by the drive unit being positioned beside the working apparatus. Thus, it suffices in the present case, if two drive units form a traveling gear axle, in particular a traveling gear rear axle, at least in some operating situations or at least over a portion of the operating phases of the earth working machine.

As already explained above, relative to the roll axis running parallel to the longitudinal machine direction, the rollable drive units comprise at least a front drive unit and at least two rear drive units. The aforementioned arrangement of the electrical energy store on the one side and the conveyor apparatus on the other side relative to the reference plane shows its advantage especially in those earth working machines, in which in at least one state of the earth working machine ready for ground removal operation the working apparatus is situated in such a way between the rear drive units along a pitch axis parallel to the transverse machine direction that respectively one rear drive unit is situated on each side of the working apparatus along the pitch axis (Ni). In other words, in this case, respectively one rear drive unit is situated on each side adjacent to the working apparatus along the pitch axis. In this case, at least one further component or a further subassembly of the earth working machine may be situated between a rear drive unit or both rear drive units and the working apparatus, so that it is not required or intended that the rear drive units be directly adjacent to the working apparatus. Normally, at least a wall of a protective housing, such as a milling drum housing, surrounding the working apparatus will be situated along the pitch axis on both sides of the working apparatus between each rear drive unit and the working apparatus.

Frequently, the machine frame is arranged so as to be height-adjustable relative to at least a portion of the rollable drive units. In the arrangement of the working apparatus in the pitch axis direction described above, the machine frame is height-adjustable at least relative to these, preferably rear, drive units by lifting devices situated between the drive units and the machine frame. In many cases, the axis of rotation of the working apparatus is non-displaceable relative to the machine frame, so that the engagement depth of the working apparatus in ground removal work is achieved by a vertical displacement of the machine frame relative to the drive units. In this case, the aforementioned arrangement of the working apparatus between the rear drive units has the advantage that a change in the height of the machine frame above the rear drive units results in an essentially equal change of the engagement depth of the working apparatus in the ground to be worked.

A rollable drive unit may be a wheel drive unit having a wheel rotating about a wheel axle or a crawler drive unit having a crawler track revolving about a track bearing. Normally, the contact surface of the crawler drive unit is greater than that of the wheel drive unit. Preferably, all drive units of an earth working machine are of the same type of construction, although in principle this does not necessarily have to be the case.

The working apparatus may comprise a milling drum having a milling drum tube coaxial to the axis of rotation, milling bits being situated on the outer circumference of the milling drum tube, the bit tips of which engage in the ground to be worked in ground work operation. Alternatively, the working apparatus may be a cutting drum with a plurality of cutting blades situated orthogonally with respect to the axis of rotation and at a distance from one another. The cutting blades may be designed like a saw blade with a geometrically defined cutting edge or like a grinding disk with bonded grain and an undefined cutting edge.

Especially in earth working machines of a smaller construction type or smaller nominal working dimensions, an efficient use of the space occupied by the earth working machine is highly advantageous. To achieve this efficient usage of installation space, at least one of the following functional devices may be situated in the longitudinal extension area of the electrical energy store:

i. a cooling device and
ii. an onboard charging device for charging the electrical energy store and
iii. a voltage transformer electrically connected to the electrical energy store.

The cooling device is preferably designed to cool the electrical energy store in convective fashion, so that a spatial proximity of the cooling device to the electrical energy store is advantageous also for the achievable cooling effect. The arrangement of the onboard charging device in spatial proximity to the electrical energy store shortens the required electrical lines between the charging device and the energy store and thus reduces, apart from the necessary installation work and use of material, electrical losses, while increasing the operational reliability.

The electric work drive may be an alternating current motor, for example a synchronous motor or an asynchronous motor. For controlling the alternating current motor, the earth working machine preferably comprises an inverter. Regardless, the electrical energy store will normally be a direct current voltage source, so that by converting the direct current provided by the electrical energy store to an alternating current, the rotational speed of the alternating current motor and the power output by the alternating current motor can be controlled. The inverter is preferably situated along the roll axis between the electrical energy store and the reference plane, so that the normally heavier electrical energy store is further removed from the reference plane, while the inverter can also still contribute toward counteracting a tipping moment caused by the conveyor apparatus.

For an effective usage of the existing installation space, the inverter and the electric work drive are preferably situated in a common longitudinal extension area of the earth working machine.

In order to provide also hydraulic energy, for example for operating lifting devices for raising and lowering the machine frame relative to the traveling gear, and/or for other hydraulic piston-cylinder assemblages, the earth working machine preferably comprises at least one hydraulic pump and at least one further electric drive as a drive of the at least one hydraulic pump. Here, it is conceivable to drive a plurality of hydraulic pumps via a further electric drive and a transfer gear or to drive exactly one hydraulic pump in a 1:1 relationship with a further electric drive.

In order for the electrical energy store to supply in a particularly advantageous manner a plurality of electrical consumers with electrical energy, the electrical energy store may be connected to a supply switching device, which supplies the electric drive of the working apparatus and at least one further electric functional device of the earth working machine with electrical energy. In a particularly advantageous development, the supply switching device may be designed as a direct current intermediate circuit.

For this purpose, the aforementioned at least one further electric functional device may comprise the at least one further electric drive of the hydraulic pump, and possibly additional electric drives and/or electric consumers.

The earth working machine preferably does not comprise a combustion engine, The earth working machine may comprise a combustion engine as an auxiliary unit in order to recharge an empty electrical energy store at least partially or in order to be able quickly to provide hydraulic pressure at the earth working machine in the event of an empty energy store. Such an auxiliary unit combustion engine, however, has a nominal power output of no more than 15 KW such that it does not suffice for earth working operation.

The present invention will be explained in greater detail below with reference to the enclosed drawings. The figure shows:

FIG. 1 a side view of a specific embodiment according to the invention of an earth working machine in the form of a cold milling machine.

In FIG. 1, illustrated in a side view, a specific embodiment according to the invention of a self-propelled earth working machine in the form of a cold milling machine is generally indicated by reference numeral 10.

The self-propelled earth working machine 10 comprises a traveling gear 12 standing on the ground U, the traveling gear 12 supporting a machine frame 14. Further components and modules are attached to the machine frame 14, which are in part rigidly connected to the machine frame 14, and in part movable relative to the machine frame 14, such as for example a front hood 16 swivable about a swivel axis that is orthogonal to the drawing plane of FIG. 1. A lateral surface of the front hood 16 facing the viewer of FIG. 1 is not shown so that the viewer of FIG. 1 is able to look into the front area of the earth working machine 10 surrounded by the front hood 16.

The self-propelled earth working machine 10 is described in the following with the aid of a Cartesian coordinate system customary for vehicles composed of the roll axis Ro, the yaw axis Gi and the pitch axis Ni. The roll axis Ro runs parallel to the longitudinal machine direction L, the arrowhead of which in FIG. 1 points in the forward travel direction of the earth working machine 10. The yaw axis Gi runs in parallel to the vertical machine axis H, which normally runs orthogonally with respect to the ground U, on which the earth working machine 10 stands. The pitch axis Ni runs parallel to the transverse machine direction Q.

The traveling gear 12 has two front drive units 18, which are situated along the roll axis Ro at the same longitudinal position in straight-ahead travel and thus form a front axle 20 of the traveling gear. Of the two front drive units 18, only the right drive unit 18 situated closer to the viewer of FIG. 1 can be seen in its entirety. The left drive unit 18 situated further away from the viewer of FIG. 1 is slightly offset with respect to the right drive unit 18 along the roll axis Ro toward the rear of the earth working machine 10, in particular by less than the radius of the two equally dimensioned drive units 18, in order to enlarge the maximum possible steering angle in one steering direction.

The traveling gear 12 also comprises two rear drive units 22, of which only the right rear drive unit 22 situated closer to the viewer of FIG. 1 can be seen. In the operating situation illustrated in FIG. 1, the two rear drive units 22 are also situated at a common longitudinal position along the roll axis Ro and thus form a rear traveling gear axle 24.

All drive units 18 and 22 shown in FIG. 1 are wheel drive units. In a variant, some or all drive units of the earth working machine 10 may be crawler drive units. The use of crawler drive units in earth working machines of the size and removal capacity shown in FIG. 1 is less common, however, than the use of the wheel drive units shown.

A working unit 26 is situated on machine frame 14 for joint displacement with the machine frame 14, which is designed for material-removing milling work on the ground U. Visible from the outside is a milling drum housing 30, which in a manner known per se encases, on all sides except toward the ground U, a milling drum 28, rotatable in FIG. 1 about an axis of rotation R running parallel to the pitch axis, as the material-removing working apparatus of the earth working machine, so that a cutting engagement of the milling drum 28 with the ground U is possible. The milling drum 28 is represented merely by a dashed line indicating its cutting circle CC. The cutting circle CC shows the contour of a rotational cutting body 29 formed by the milling drum 28 rotating about the axis of rotation R. The rotational cutting body 29 may have different diameters in different axial sections. Sometimes, the cutting circles CC and thus the local diameters of the rotational cutting body 29 are smaller in the axial end regions of the milling drum 28 than in the axial central regions of the milling drum 28, for example in order to produce a milling path that is profiled in the transverse direction, i.e., in the present illustration, orthogonally with respect to the drawing plane of FIG. 1.

A milling edge F behind the milling drum housing 30 in FIG. 1 and a ramp A, below machine frame 14, of an already produced milling path indicate that the earth working machine 10 has already partially removed the ground U.

The machine frame 14 is connected to the rear drive units 22 via lifting columns 32 in a height-adjustable manner. Only the lifting column 32 facing the viewer of FIG. 1 is shown. Since the rear drive units 22 in the operating situation shown in FIG. 1 are alongside each other along the pitch axis Ni of the milling drum 28, possibly with the interposition of further components, for example a milling drum transmission on the side facing away from the viewer of FIG. 1, and since the milling drum 28 is thus located between the two rear drive units 22 in the transverse machine direction Q, the engagement depth T of the milling drum 28 into the ground U may be set by adjusting the machine frame by way of lifting columns 32. As an alternative to the solution shown in FIG. 1, the milling drum 28 may be mounted in height-adjustable fashion on the machine frame in order to change the engagement depth T. In cold milling machines of the size and removal capacity shown in FIG. 1, however, this is also less common than the solution shown in FIG. 1.

The rear drive unit 22 facing the viewer in FIG. 1—and only this drive unit—is displaceable by a displacement mechanism 34 from the illustrated position along the roll axis Ro toward the front and along the pitch axis Ni away from the viewer of FIG. 1 to a position in front of the milling drum housing 30, so that in the displaced state the lateral surface of the milling drum housing 30 facing the viewer of FIG. 1 forms a boundary of the movement space of the earth working machine 10 on the right side shown in FIG. 1, which is the so-called "zero side" of the earth working machine 10. With the zero side rear drive unit displaced to a position in front of the milling drum housing 30, the earth working machine 10 is able to approach obstacles along the pitch axis Ni on the zero side with a particularly small clearance.

Above the working apparatus 28, there is an operator's platform 36, on which an operator of the earth working machine 10 is able to sit or stand during travel operation and during ground removal operation in order to operate and control the earth working machine 10 using control apparatuses 38 situated on the operator's platform 36.

In order to convey milled material, that is, ground material removed by the milling drum 28, away from the earth working machine 10, a conveyor apparatus 40 is situated on the rear end of the earth working machine 10. The conveyor apparatus 40 is a belt conveyor apparatus, which conveys milled material along the arrow W from a receiving area 40*a* near the milling drum 28, where removed ground material is received by the conveyor apparatus, to a longitudinal discharge end 40*b* of the conveyor apparatus 40, from where the conveyed milled material is discharged in the longitudinal machine direction L.

Because of the described arrangement of the conveyor apparatus at the rear end of the earth working machine 10, the earth working machine 10 is a rear loader machine.

The conveyor apparatus 40 is releasably connected to the machine frame 14 via a receiving configuration 42, so that for facilitating a transport of the earth working machine 10 over a longer distance, which the earth working machine 10 does not travel in self-propelled fashion, the conveyor apparatus 40 can be removed from the machine frame 14.

In the present case, the receiving configuration 42 is formed by three spatially separate partial receiving configurations 42*a*, 42*b* and 42*c* on the machine frame 14. In the illustrated exemplary embodiment, a chain hoist 44, variable in length by a piston-cylinder assemblage 43, is situated on the partial receiving configuration 42*a*, which may be formed for example by an eye or a hook. An arresting cable 46 is situated on partial receiving configuration 42*b*, which in the event of a malfunction of the piston-cylinder assemblage 43 prevents the conveyor apparatus 40 from crashing down completely. The partial receiving configuration 42*b* may therefore also be designed as an eye or hook. The partial receiving configuration 42*c* may be formed as a mounting flange having a predefined hole pattern or the like, on which a hinged bearing 48 of the conveyor apparatus 40 may be attached, so that an angle of inclination of the conveyor apparatus 40 relative to the machine frame 14 about the axis of inclination NA can be changed within limits constructionally predefined by the chain hoist 44, the tension cable 46, and the hinged bearing 48. Additionally or alternatively, a hinged console may be situated on the partial receiving configuration 42*c*, which allows for the conveyor apparatus to swivel about a swivel axis SA in parallel to the yaw axis.

In the present exemplary embodiment, the milling drum 28 of the illustrated earth working machine 10 is driven electrically by an electric motor 50, which forms the electric work drive mentioned in the introduction of the description and which is indicated merely in rough schematic fashion by a dashed line. The electric work drive or electric motor 50, however, is preferably not situated within the space surrounding the milling drum 28 but is rather located at a distance from the milling drum 28 radially outside of that space. The electric motor 50 is thus well protected against the mechanical reactions and the dirt load in the immediate vicinity of the milling drum 28. The drive force of the electric motor 50 is transmitted by a transmission assemblage 52, which is likewise indicated only in rough schematic fashion by a dashed line, to the milling drum 28. The transmission assemblage 52 may be a single transmission or a sequence of two mutually cooperating transmissions of an identical or different type of construction, for example a combination of a belt transmission and a gear transmission, the gear transmission being preferably developed as a planetary transmission.

In the event that the electric motor 50 is an alternating current motor, for example a synchronous motor, an inverter 54 may be provided on the earth working machine 10, the receiving space of which on the earth working machine 10 preferably overlaps along the roll axis Ro with the receiving space of the electric motor 50.

As energy source, the earth working machine 10 carries along an electrical energy store 56, which in the illustrated exemplary embodiment is implemented by two cooperating energy store subunits 56*a* and 56*b*.

In order to counterbalance entirely or partially a tipping moment acting on the earth working machine 10 on account of the conveyor apparatus 40 with respect to the rear axle 24 of the traveling gear or with respect to the milling drum 28 engaging with the ground U, the electrical energy store 56, which has a great density and a great weight due to its construction type and the materials used therein, is situated on the other side of a reference plane BE containing the rotation axis R of the working apparatus and extending parallel to the yaw axis Gi of the earth working machine, opposite the conveyor apparatus 40.

Particularly advantageously, the electrical energy store 56 is situated above the front axle 20 of the traveling gear and thus improves the traction of the front drive units 18 and consequently the steerability of the earth working machine 10.

The arrow DA in FIG. 1 indicates the distance of the receiving configuration 42 from the reference plane BE, this distance being determined by using the partial receiving configuration 42*c* closest to the reference plane BE in the exemplary embodiment. The arrow DE indicates the distance of the electrical energy store 56 from the reference plane BE. To determine the distance of the energy store 56, composed of the energy store subunits 56*a* and 56*b*, from the reference plane BE, the distance of each energy store subunit 56*a* and 56*b* is to be determined and weighted with the weight of the respectively associated energy store subunit 56*a* and 56*b*. The distance DE then results from the arithmetic mean of the weighted distances of the energy store subunits 56*a* and 56*b*.

The distance DE is greater than the distance DA, which in turn is greater than the radius of the rotational cutting body 29. In the illustrated exemplary embodiment, the distance DA amounts to approximately 105% to 115% of the radius of the rotational cutting body 29. In the illustrated exemplary embodiment, the distance DE is greater than three times the distance DA. In the illustrated exemplary embodiment, the distance DE amounts to approximately 102% to 108% of three times the distance DA.

So that the electric work drive (electric motor) 50 can also contribute toward compensating for the tipping moment produced by the conveyor apparatus 40, the electric work drive in the form of the electric motor 50 is also situated on the other side of the reference plane BE, opposite the conveyor apparatus 40. In the illustrated exemplary embodiment, the electric motor 50 is situated between the reference plane BE and the electric energy store 56. Based on the above description, the same is true of the inverter 54.

The earth working machine 10 may also comprise a further electric motor 58, which drives at least one hydraulic pump 60. The further electric motor 58 and the at least one hydraulic pump 60 are also situated on the other side of the reference plane BE, opposite the conveyor apparatus 40. In the illustrated exemplary embodiment, both the hydraulic pump 60 as well as the further electric motor 58 are situated along the roll axis Ro between the electrical energy store 56 and the reference plane BE, preferably only between these.

To be able to implement short line paths, an onboard charging device 62 is situated in the longitudinal extension area and preferably also in the vertical extension area of the electrical energy store 56. A voltage transformer 64, which transforms the direct current voltage normally supplied by the electrical energy store 56 to a voltage value different from the terminal voltage of the energy store 56, may likewise be situated, like the onboard charging device 62, in the longitudinal extension area and preferably also in the vertical extension area of the electrical energy store 56.

The direct current voltage transformed by the voltage transformer 64 can be used to operate for example a direct current ventilator 66, which is provided in direct proximity of the electrical energy store 56 to cool the latter in convective fashion. In the illustrated example, the receiving space of the ventilator 66 along the roll axis Ro overlaps with the receiving space of the electrical energy store 56 on the earth working machine 10. Since the electrical energy store 56 is beveled at its upper front end and the ventilator 66 is situated above the bevel, the receiving space of the ventilator 66 and the receiving space of the electrical energy store 56 overlap with a particularly advantageous utilization of the installation space available overall at the longitudinal front end of the earth working machine 10 even along the yaw axis Gi.

The travel drive of the self-propelled earth working machine 10 may also have an electric motor, which is likewise supplied with electrical energy by the electrical energy store 56. In a particularly preferred embodiment, the earth working machine 10 comprises a supply switching device 68, for example a direct current intermediate circuit, into which the electrical energy store 56 feeds electrical energy, and to which the electrical work drive 50 and further electric consumers, such as for example the voltage transformer 64 with the ventilator 66 and the further electric motor 58 for operating the hydraulic pump 60 and a travel drive motor, normally with the interposition of voltage transformers and/or inverters, depending on the operating mode of the respective further electric motors, are connected for controlling the further electric motors.

The invention claimed is:

1. A self-propelled earth working machine, comprising:

a machine frame having a roll axis running parallel to a longitudinal machine direction and a pitch axis running parallel to a transverse machine direction perpendicular to the longitudinal machine direction;

at least one front rollable drive unit and at least two rear rollable drive units supporting the machine frame, wherein the at least one front rollable drive unit forms a front drive axle and the at least two rear rollable drive units form a rear drive axle;

a working apparatus for ground removal work supported from the machine frame such that the working apparatus is rotatable about an axis of rotation, wherein in at least a state of the earth working machine ready for ground removal operation, the working apparatus is located directly between the two rear rollable drive units such that one rear rollable drive unit is situated on each side of the working apparatus along the axis of rotation of the working apparatus;

an electric work drive configured to drive the working apparatus to perform a rotating working movement effecting the ground removal work during a ground removal operation;

an electrical energy store configured to output electrical energy to the working apparatus during the ground removal operation, at least a portion of the electrical energy store being located directly above the front drive axle;

a receiving configuration configured to receive a conveyor to transport removed ground material; and wherein in a reference state in which the earth working machine stands on level ground, the electrical energy store and the receiving configuration are situated on opposite sides of a reference plane containing the axis of rotation of the working apparatus and extending orthogonal to the level ground.

2. The self-propelled earth working machine of claim 1, further comprising:

a conveyor mounted on the receiving configuration, the conveyor being configured to convey ground material removed during a ground removal operation in a rearward direction away from the working apparatus.

3. The self-propelled earth working machine of claim 1, wherein:

the electric work drive is located in the longitudinal machine direction between the reference plane and the electrical energy store.

4. The self-propelled earth working machine of claim 1, wherein:

the electrical energy store is at least as far removed from the reference plane as is the receiving configuration.

5. The self-propelled earth working machine of claim 4, wherein:

the electrical energy store is at a distance from the reference plane equal to at least one-half of a maximum diameter of a rotational cutting body formed by the rotating working apparatus.

6. The self-propelled earth working machine of claim 1, wherein:

the electrical energy store defines a longitudinal extension of the electrical energy store relative to the machine frame; and the earth working machine further includes at least one functional device selected from the group consisting of a cooling device, an onboard charging device for charging the electrical energy store, and a voltage transformer electrically connected to the electrical energy store, the at least one functional device being located within the longitudinal extension of the electrical energy store relative to the machine frame.

7. The self-propelled earth working machine of claim 1, wherein:

the electric work drive includes an alternating current motor; and the earth working machine further includes an inverter located in the longitudinal machine direction between the reference plane and the electrical energy store.

8. The self-propelled earth working machine of claim 7, wherein:

the inverter and the electric work drive are situated in a common longitudinal extension of the machine frame.

9. The self-propelled earth working machine of claim 1, further comprising:

a hydraulic pump; and a further electric drive configured as a drive of the hydraulic pump.

10. The self-propelled earth working machine of claim 1, further comprising:

at least one further electric functional device; and a switch connecting the electrical energy store with the electric work drive and the at least one further electric functional device.

11. The self-propelled earth working machine of claim 10, further comprising:

a hydraulic pump; and wherein the at least one further electric functional device includes a further electric drive configured to drive the hydraulic pump.

12. The self-propelled earth working machine of claim 1, wherein:

the receiving configuration is at a distance from the reference plane equal to at least one-half of a maximum diameter of a rotational cutting body formed by the rotating working apparatus.

* * * * *